US005433646A

United States Patent [19]

Tarng

[11] Patent Number: 5,433,646

[45] Date of Patent: Jul. 18, 1995

[54] WATER GUN LAUNCHING WATER GRENADE

[76] Inventor: Min M. Tarng, 1367 Glenmoor Way, San Jose, Calif. 95129

[21] Appl. No.: 60,250

[22] Filed: May 11, 1993

[51] Int. Cl.[6] ..... A63H 33/30; A63H 5/04; A63H 27/26; B05B 15/00

[52] U.S. Cl. ..... 446/473; 446/405; 446/401; 446/267; 446/211; 222/78; 239/289; 239/214.13

[58] Field of Search ..... 239/211, 214.13, 214.17, 239/214.21, 289; 222/78, 79, 401; 446/176, 180, 185, 189, 194, 196, 211, 267, 399, 400, 401, 405, 429, 435, 473, 475, 483

[56] References Cited

U.S. PATENT DOCUMENTS

| | | | |
|---|---|---|---|
| 1,634,976 | 7/1927 | Burke, Jr. | 222/79 X |
| 2,589,977 | 3/1952 | Stelzer | 222/79 |
| 2,991,782 | 7/1961 | Ayala | 446/211 X |
| 3,049,832 | 8/1962 | Joffe | 446/212 |
| 3,739,764 | 6/1973 | Allport | 446/429 X |
| 4,591,071 | 5/1986 | Johnson | 222/79 X |
| 4,757,946 | 7/1988 | Johnson | 446/473 X |
| 4,890,838 | 1/1990 | Rudell et al. | 446/267 X |
| 5,074,437 | 12/1991 | D'Andrade et al. | 222/79 |
| 5,150,819 | 9/1992 | Johnson et al. | 222/79 |
| 5,240,450 | 8/1993 | Graham | 446/267 |

FOREIGN PATENT DOCUMENTS

| | | | |
|---|---|---|---|
| 287783 | 3/1928 | United Kingdom | 239/214.13 |
| 642926 | 9/1950 | United Kingdom | 222/79 |

OTHER PUBLICATIONS 2733 699 2-56 Krinsky.

5288 256 2-94 Lee et al. Nov. 1992.

*Primary Examiner*—Michael A. Brown

*Assistant Examiner*—D. Neal Muir

[57] ABSTRACT

A water gun system comprises a water gun, firing sound emulator, launching tube and rocket type water grenade. Converting the air pressure to be the momentum, the water gun generates the chain shot made of the air and fluid and the firing sound emulator generates the click sound of machine gun. Converting the air pressure to be momentum, the launching tube fires rocket type water grenade. Hitting on the target, the rocket type water grenade sprays fluid on the enemy.

15 Claims, 9 Drawing Sheets

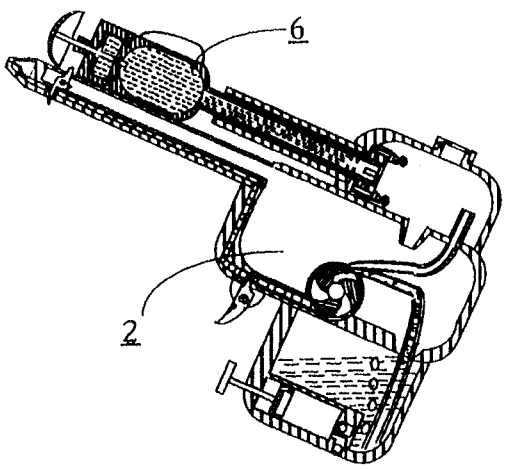
FIG.13D
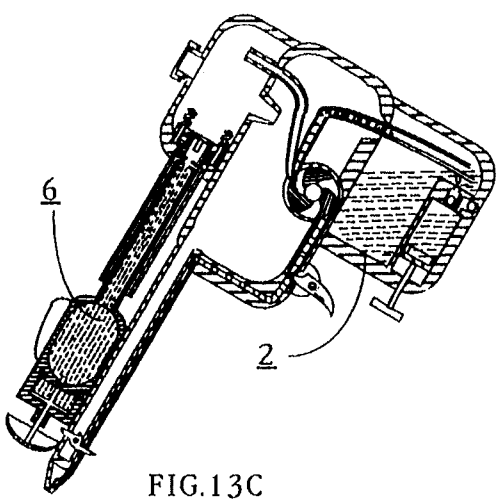
FIG.13C
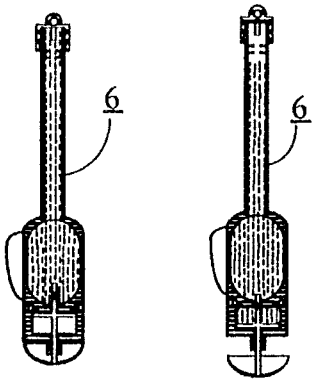
FIG.13B
FIG.13A
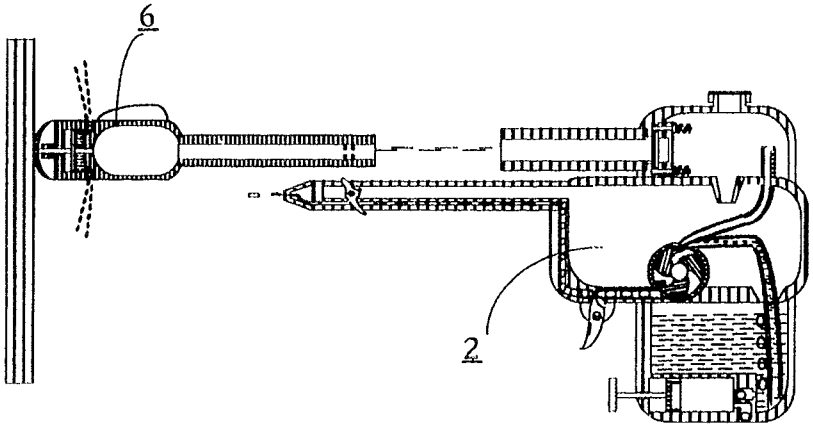
FIG.13F
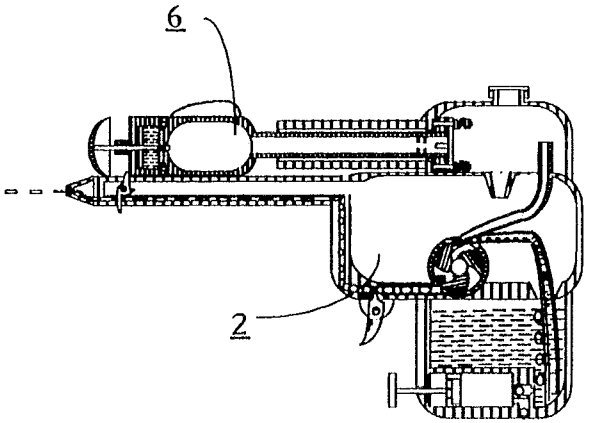
FIG.13E

WATER GUN LAUNCHING WATER GRENADE

BACKGROUND

1. Field of Invention

The water gun launches the water grenade as a grenade launcher and fires the water chain shots accompanied with the synchronous firing click sounds.

2. Description of Prior Art

The conventional water gun projects the stream of fluent. It doesn't simulate the chain shot of machine gun. It doesn't have the sound effect of the chain shot, either. None of the conventional water guns can launch the water grenade. The innovative idea of water gun launched water grenade doesn't exist until now. The water jet not only wastes water but also loses the real battlefield effect. After only a few shots, the player has to stop the battle looking for the faucet to refill the water gun again.

The conventional nozzle has no acceleration effect. The water is uncompressible fluid. It can not expand to accelerate like the gas does. There is no acceleration of the "water bullet". The water pressure drops immediately at the exit of the nozzle. The energy transform is not efficient so that the range is reduced.

During the childish mock combat, the refill of water for the water gun is inconvenient and time-consuming. It is the most dangerous time to be attacked by the enemy. Even worse, as the cap is open or the water tank is removed, the air pressure inside the water reservoir or water tank is released. It takes a lot of time to pump the air to build up the air pressure inside the tank again. Furthermore, while the grenade is a very important combating armor, so far there is no water gun to launch the water grenade.

I invent a water gun which can launch the water grenade. The pumping action is designed to fit the human mechanics. The air pressure is built up with the pumping action of the middle finger, ring finger and little finger. The water gun is triggered with the index finger. One hand can operate the water gun; another hand can install, fire or throw the water gun. The water grenade serves as the portable water reservoir, too. The water grenade can be installed on the water gun quickly and the water gun is refilled immediately. There is no loss of the air pressure that the combat can continue without interrupt.-The water gun fires a series of spurts of water accompanied with the clicks of firing sound and mechanical vibration. The "air propellant" and "water bullet" are alternatively aligned to form the chain shot to constitute a series of spurts. The compressible air expands in the pipe that the water bullets are accelerated. The energy transformation is complete that the shooting range is much longer.

OBJECTS AND ADVANTAGES

The water grenade not only serves as the water reservoir but also can be launched by the water gun as a bazooka. The water gun fires a series of spurts of water bullet to simulate the chain shot accompanying with the firing sound and mechanical vibration.

DRAWING FIGURES

FIG. 13 is the series of the operations of the water gun and the water grenade; (A) the water grenade serves as the portable water reservoir; (B) the water grenade has the impact head been pulled out; the payload compartment is filled with water; (C) the water grenade is slided in the launch tube to be mounted on the water gun; (D) the water gun points upward and the water flows from the propellant compartment in the water grenade to the water reservoir in the water gun; (E) the water gun fires the chain shot made of water spurts; (F) the water gun launches the water grenade; as the water grenade hits on the target, the water sprays out.

FIG. 14 is the manual operation of the water grenade; (A) the impact head is pulled out; (B) the impact head is pushed in and the water spurts are squeezed out; (C) the water grenade serves as the hand grenade.

DESCRIPTION OF PREFERRED EMBODIMENTS

Figure 1:
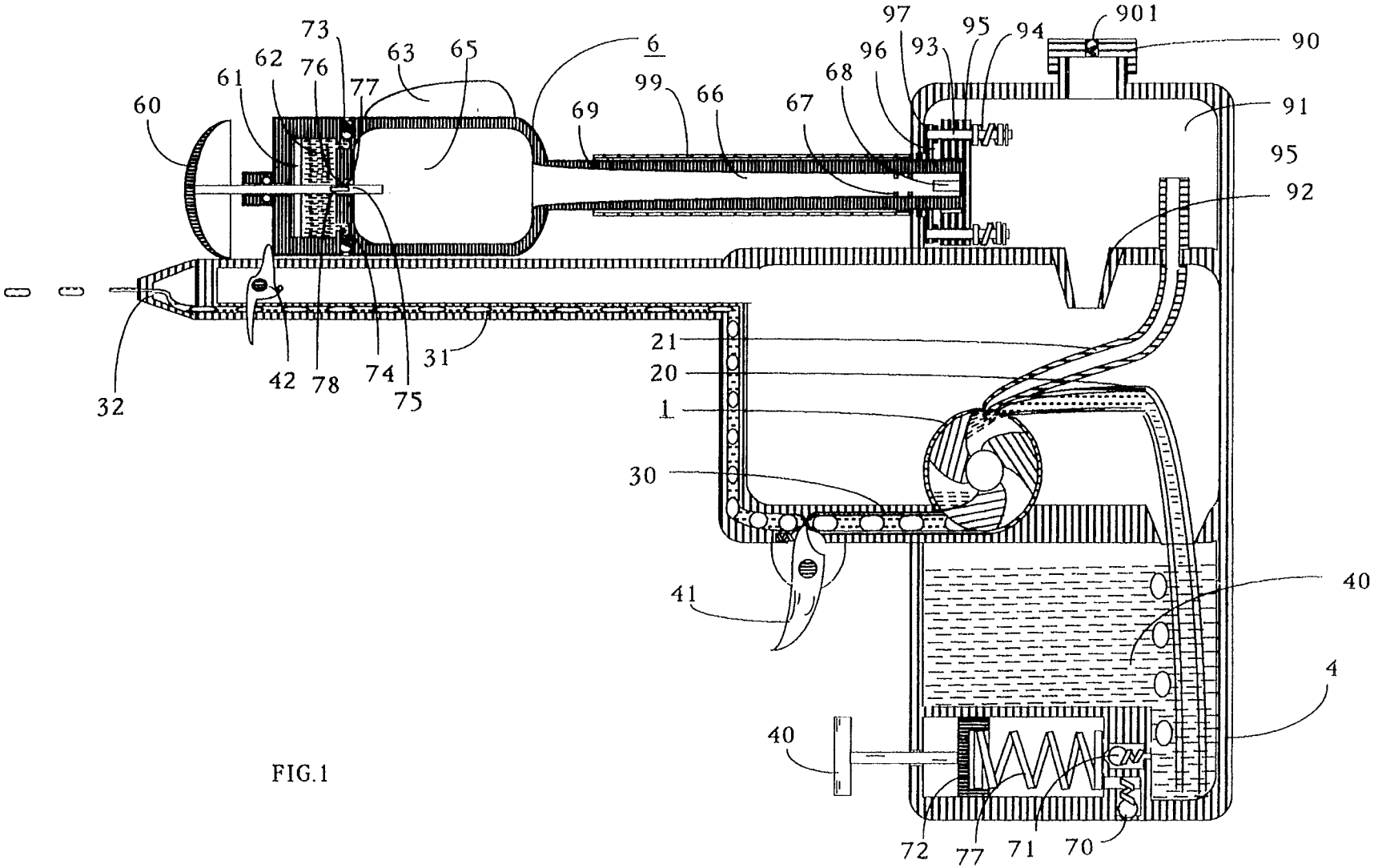
FIG. 1 is the side cross-section view of the water gun having the water grenade mounted on it. The air pressure is built up with the pumping action of the fingers.

The water gun comprises a spray gun, a firing sound emulator, a launching tube and a water grenade. The spray gun is to convert the air and fluid to be chain shots. The launching tube is to launch the water grenade with the air pressure. The firing sound emulator is to generate the click sound of the machine gun. FIG. 1 shows my invention implemented with the manual pump to pump up the air pressure. As the kid holds the handle 4 of the water gun, his middle finger, ring finger and the little finger hold and press the pumping pad 40 to pump up the air pressure. The index finger presses the trigger 41 to eject a series of spurts of water.

As the pumping pad 40 is pressed, the piston 72 compresses the air/gas inside the cylinder to flow through the one way valve 71 into the water reservoir. As the pumping pad 40 is released, the spring 77 expands and the vacuum inside the cylinder sucks the air/gas flowing through one-way valve 70 into the cylinder. Continuing pumping the pumping pad 40, the air pressure inside the water reservoir is built up.

Figure 5B:
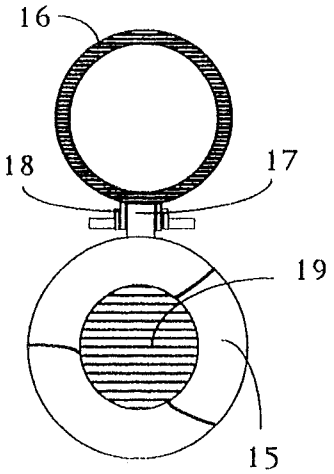
FIG. 5 (A) is the transverse section view of the spurting mechanism; (B) is the side cross-section view of the firing sound emulator mechanism.
Figure 6B:
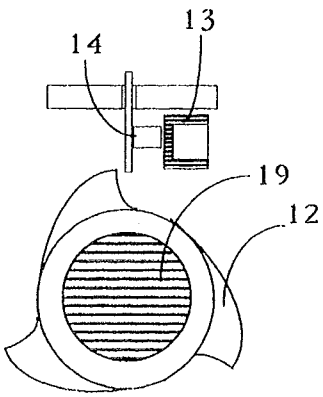
FIG. 6 (A) is the transverse section view of the electrical motor, water turbine and air turbine in the turbocharging type spurting mechanism; (B) is the side cross-section view of the alternative design for the firing sound emulator mechanism.
Figure 5A:
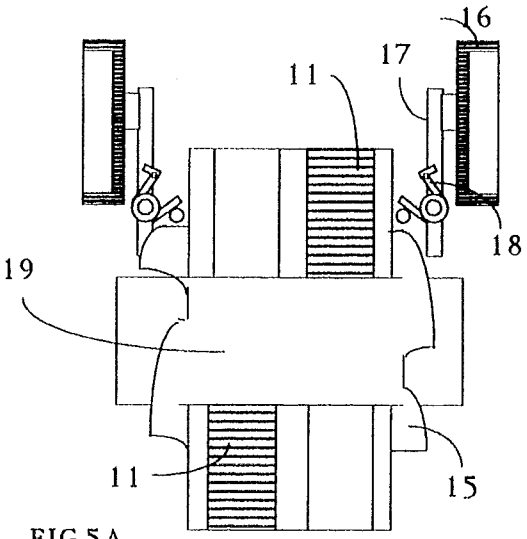

The trigger 41 is biased to lock the outlet pipe 31. As the trigger 41 is pressed to release the lock of the outlet pipe, the pressure inside the turbine decreases due to the turbine being neither air-tight nor water-tight. The air pressure in the water gun is much larger than the hydraulic head of the water column in the inlet pipe and the pressure in the turbine is almost the same as the pressure of the outlet pipe. Under the high pressure inside the water reservoir, the air/gas is forced to flow through the inlet pipe 21 and the water/fluent material is forced to flow through the inlet pipe 20. The air jet and water jet impinge on the blades of the turbine 1 alternately. As the turbine 1 rotates, the firing sound emulator generates the synchronous firing sound as shown in FIG. 5 and FIG. 6. At the same time, the turbine 1 inserts the air segment and water segment into the outlet pipe 30 alternatively as shown in FIG. 7 and FIG. 8.

Figure 4A:
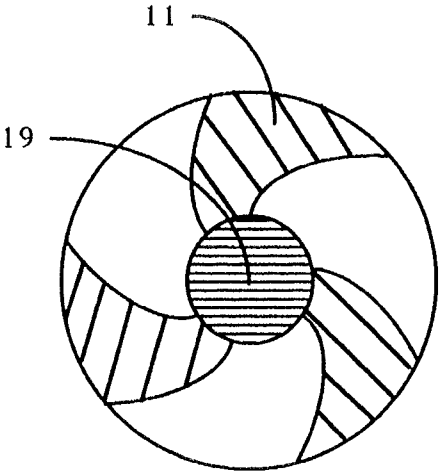
FIG. 4 (A) is the side cross-section view of the water turbine in the spurting mechanism; (B) is the side cross-section view of the air turbine in the spurting mechanism.
Figure 4B:
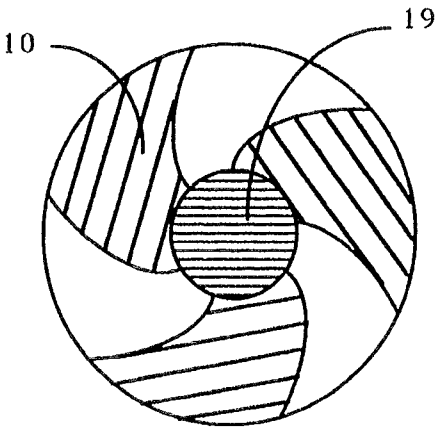
Figure 7A:
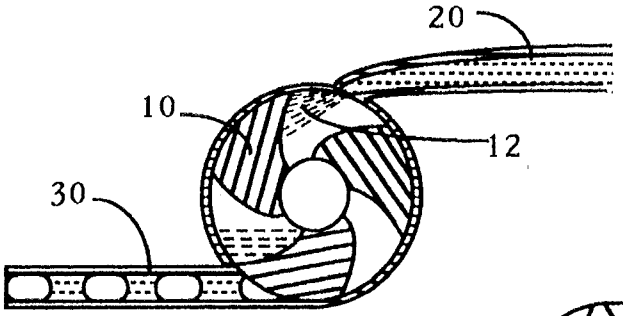
FIG. 7 (A) is the cross section view of the water turbine during the water jet period; (B) is the cross section view of the air turbine during the water jet period; the air jet is blocked by the van of the air turbine; the air is injected into the outlet pipe to form the chain shot.
Figure 7B:
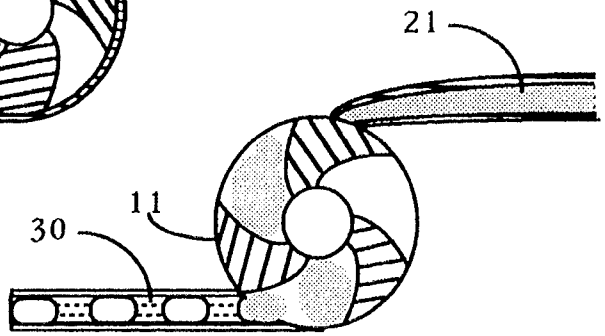
Figure 8A:
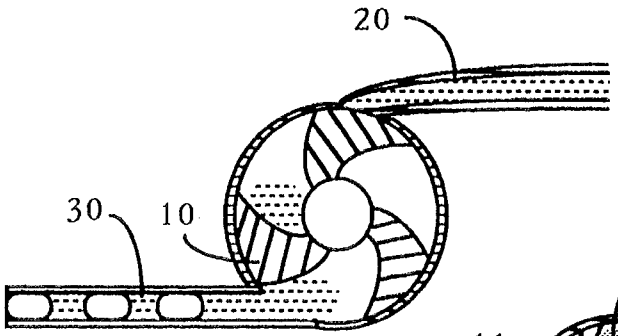
FIG. 8 (A) is the cross section view of the water turbine during the air jet period; the water jet is blocked by the van of the water turbine; the water is injected into the outlet pipe to form the chain shot; (B) is the cross section view of the air turbine during the air jet period.
Figure 8B:
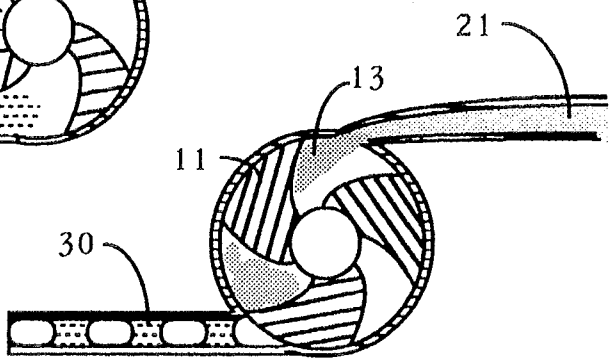

The core of the water gun is the air turbine and the water turbine. As shown in FIG. 4, the turbine 1 constitutes of the air turbine 11 and water turbine 10 having the same axle 19. As shown in FIG. 5, the blades of water turbine and air turbine interlace each other, i.e., the van sections of air turbine 11 are out of phase with the van sections of water turbine 10. As shown in FIG. 7A, as the water jet impinges on the blade of the water turbine, the air passage is blocked by the blade section of air turbine as shown in FIG. 7B. The turbine 1 is driven to rotate under the impinging force of the water jet. As shown in FIG. 8B, as the air jet impinges on the blade of the air turbine, the water passage is blocked by the blade section of water turbine as shown in FIG. 8A. The turbine 1 is driven to rotate under the impinging force of the air jet.

The firing sound emulator is to convert the air pressure to be the cliek sound. The firing sound emulator comprises the cam and drum. As shown in FIG. 5, the cam 15 is one unit with the axle 19. The drum stick is biased by the spring 18. As the turbine 1 rotates, the cam 15 raises up and suddenly releases the drum stick 17. The drum stick 17 hits on the drum to generate the firing click sound.

Figure 6A:
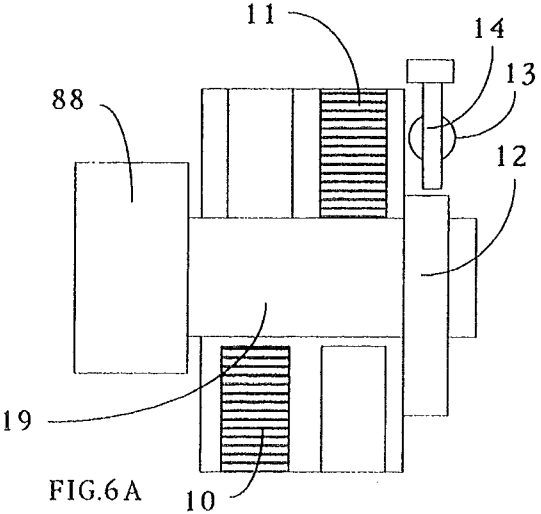

FIG. 6 shows the turbine mechanism of the turbocharge type water gun. The electrical motor 88 is installed in the water gun as shown in FIG. 6A. The motor 88 drives the turbine 1 to rotate. The turbine sucks the water and air into the turbine and compresses them to flow through the outlet pipe 30.

FIG. 6 also shows the alternative design of the firing sound emulator. The cam 12 is one unit with the axle 19. As the turbine 1 rotates, the cam 12 raises up and suddenly releases the drum stick 14. The drum stick 14 hits on the drum 13 to generate the firing click sound.

Figure 2:
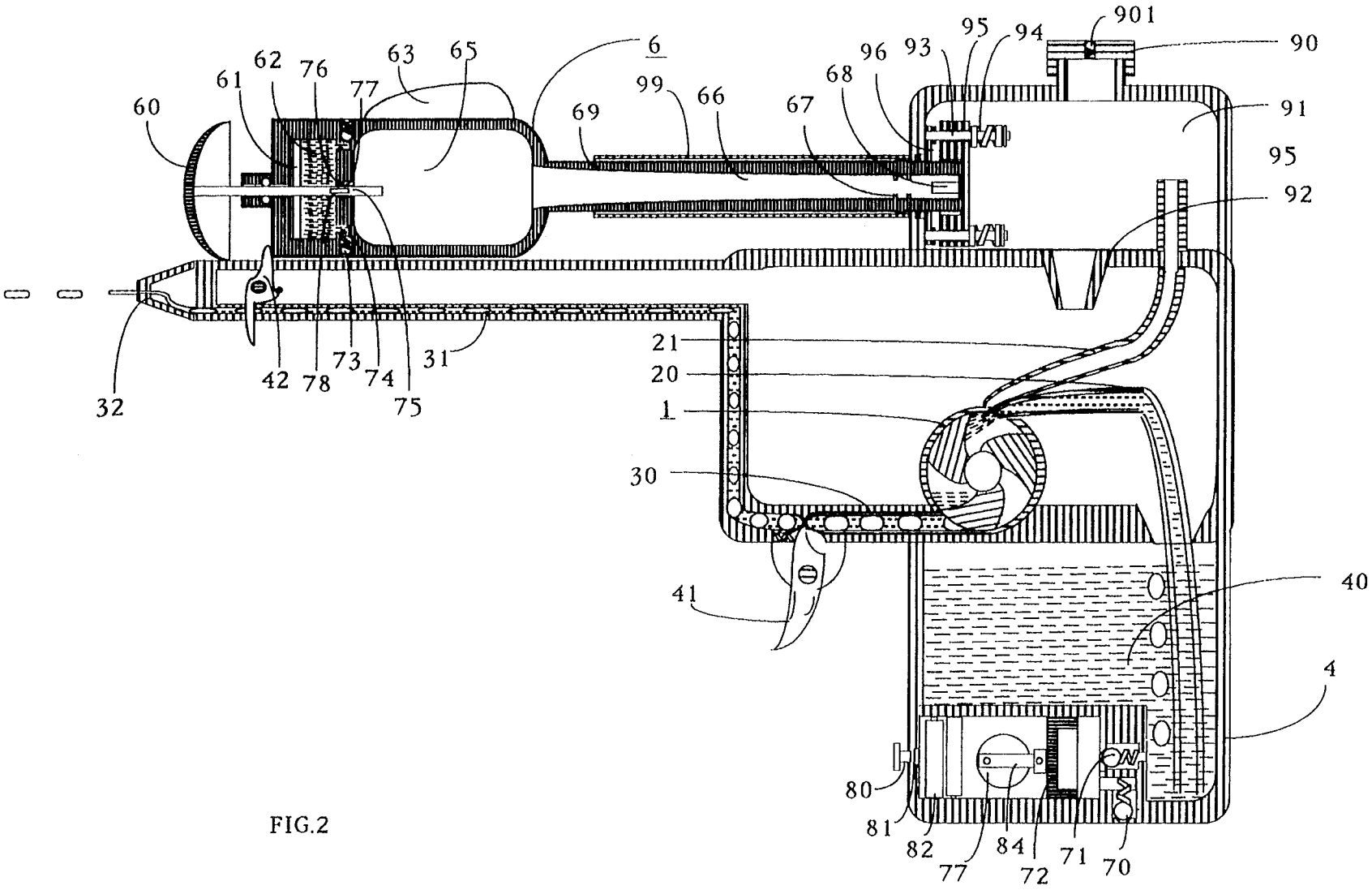
FIG. 2 is the side cross-section view of the water gun having the water grenade mounted on it. The air pressure is built up with the reciprocal motion of the electrical motor.

FIG. 2 is the water gun using the battery 82 to rotate the electric motor 77. As the motor 77 rotates the link 84, the valve 72 moves back and forth reciprocally and the air is pumped into the reservoir 4.

Figure 3:
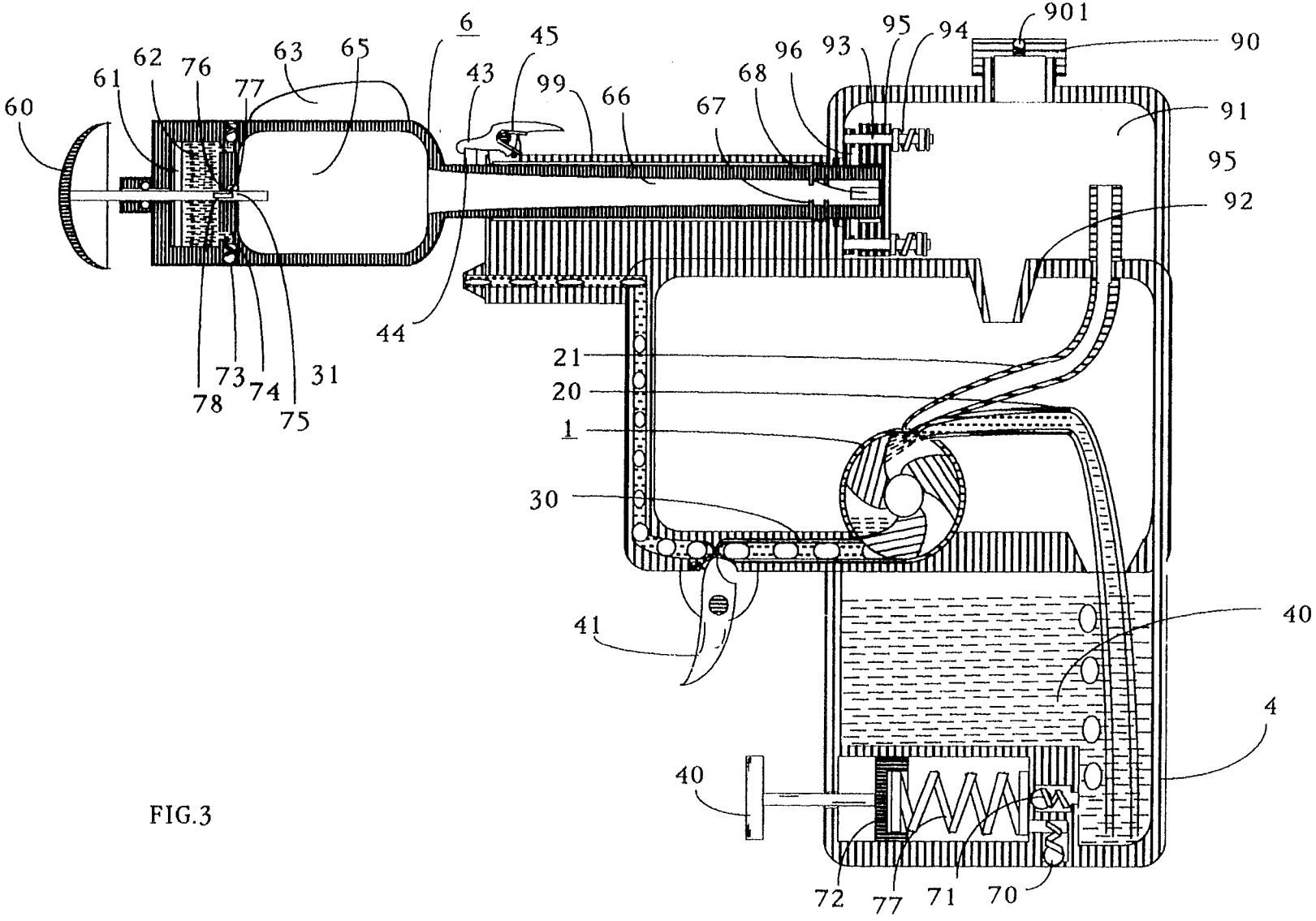
FIG. 3 is the side cross-section view of the water gun having the water grenade been launched with the launch tube of the water gun.

FIG. 3 is the alternative design of the water gun. The trigger 43 of the water grenade is located on the pipe of the water gun. The spring 45 bias the trigger 43 to hook the ring 44 of the water grenade.

Figure 9:
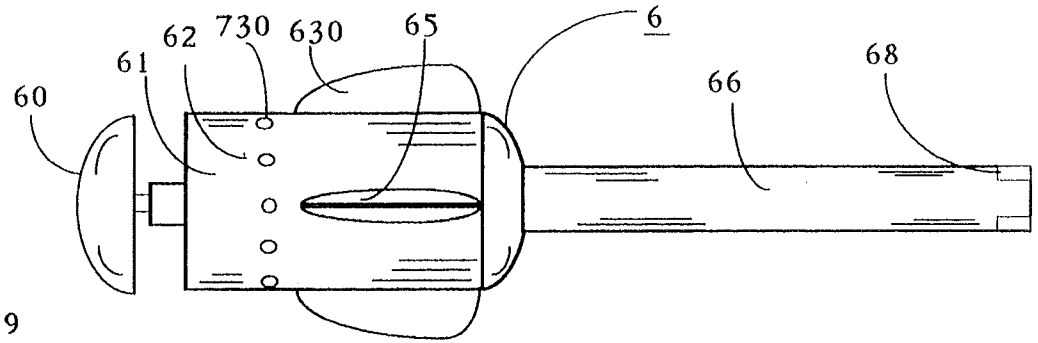
FIG. 9 is the top view of the water grenade.
Figure 10A:
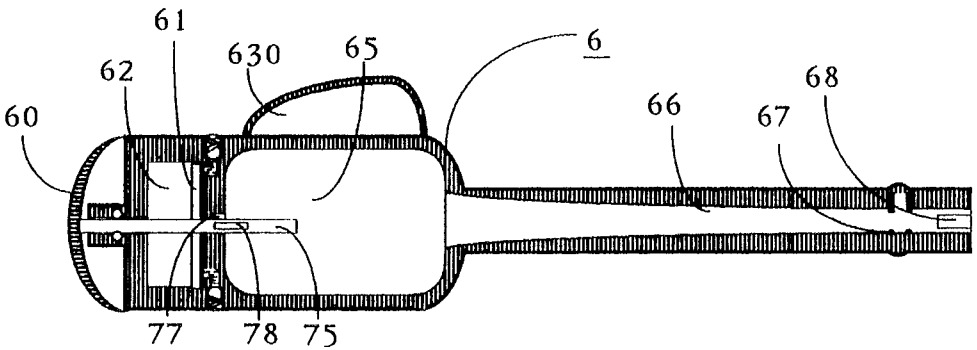
FIG. 10 (A) is the cross-section view of the water grenade; (B) is the cross-section view of the water grenade filled with the water.
Figure 10B:
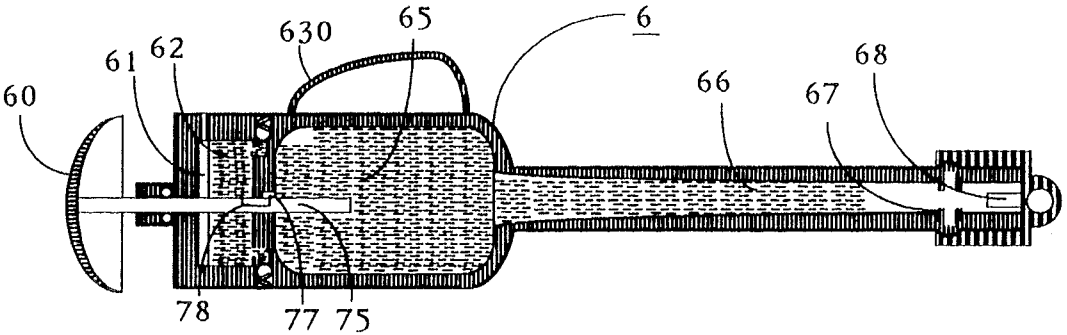
Figure 11:
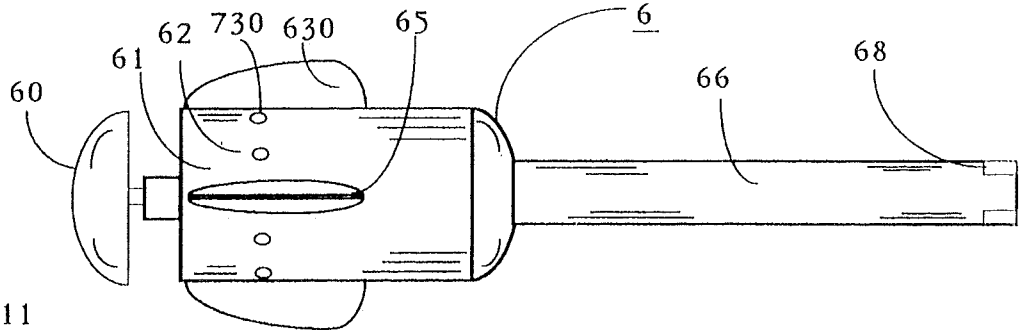
FIG. 11 is the top view of the discharging water grenade.

Referring to FIG. 1, the reservoir cap 90 can be opened to fill the reservoir 40 with the fluent material. However, it is much more convenient way to fill the reservoir with the water grenade 60. The water grenade 6 can be launched with water gun or thrown with hand. The water grenade 6 is slidably mounted on the launching tube which is located at top of the water gun 2. The handle 66 slides inside the barrel 99. As shown in FIG. 9, the water grenade 6 is similar to the bazooka. There are fins 63 to stabilize the flying attitude. As shown in FIG. 10A, the water grenade is constituted of the impact head 60, trippet 61, payload compartment 62 and propellent compartment 65. As shown in FIG. 13A, the water grenade 6 is filled with the water. As shown in FIG. 10B, the slot 77 in the wall and the slot 78 in the pole 75 of trippet 61 are constituted of a passage. As the impact head 60 is pulled out, the vacuum is generated in the payload compartment 62. As shown in FIG. 13B and FIG. 10B, the water is sucked into the payload compartment 62 from the propellant house 65. After the water is sucked into the payload compartment 62, turn the impact head 90 degrees, the slot 77 in the wall and the slot 78 in the pole 75 of trippet 61 are disconnected as shown in FIG. 1. As shown in FIG. 13C, the water grenade 6 is installed on the water gun 2 with the water gun 2 pointing downward. As shown in FIG. 1, the handle 66 slides into the barrel 99. The breechblock 95 is pushed by the handle 66 to open a gap 96. As shown in FIG. 13D, the water gun 2 points upward and the water flows into the reservoir 4; the compressed air flows into the propellent compartment 65. In FIG. 13E, the water gun is fired.

In FIG. 1, the water gun is at the instant of finishing the firing. The compressed air flows through the gap 96 and slit 68 into the propellent compartment 65 as the propellant. The barrel 99 holds the water grenade, guides the water grenade and converts the potential energy of the compressed air to the kinetic energy of the grenade. The breechblock 95 is slidably mounting on the bolts 93. To insure the seal, the rubber seal 97 is attached to the rim of the hole. As the water grenade is released to speed up in the barrel 99, under the biasing force of the spring 94, the breechblock 95 seals the opening of the barrel 99. Pressing the trigger 42 forward, the water grenade is pushed backward and the lock is released. The propellant, compressed air, expands to propel the water grenade 6 to slide in the barrel 99. The compressed air in the propellant compartment 65 expands and flows through the nozzle 69 to speed up. In this way, as shown in FIG. 13F, the water gun 2 serves as a grenade launcher. As the compressed air flows through the whistle 67, the whistling sound of the flying shell is generated. As the water grenade 6 hits on the target, the trippet 61 squeezed the water in the payload compartment. The water grenade explodes, i.e., the water flows through the valve 73 and sprays on the enemy.

Figure 12A:
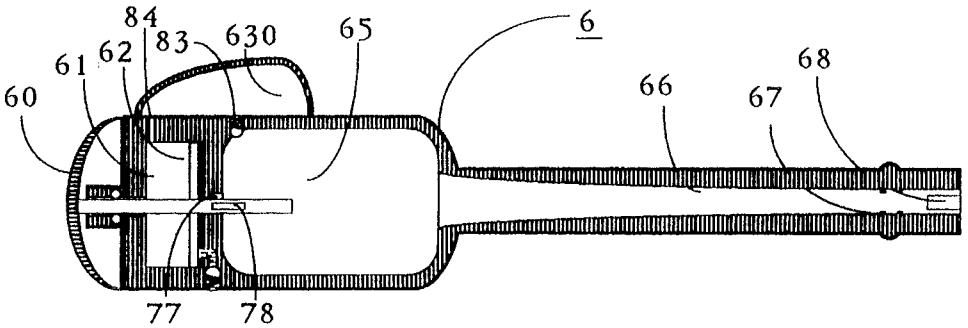
FIG. 12 (A) is the cross-section view of the discharging water grenade; (B) is the cross-section view of the discharging water grenade filled with the water.
Figure 12B:
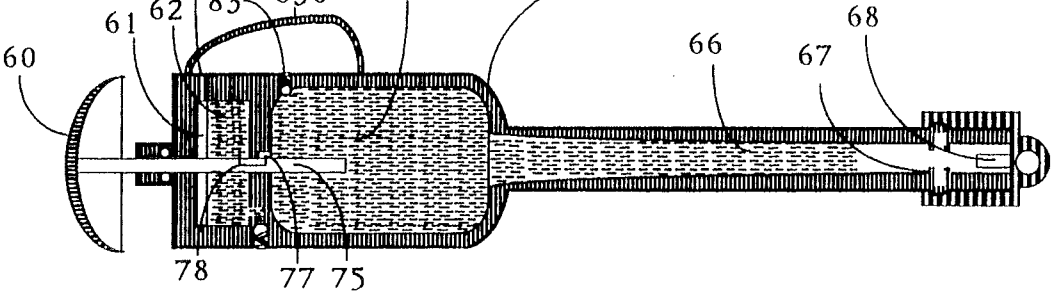

To expel the water completely from the payload compartment 62, as shown in FIG. 12, the wings 630 have the explosion compartment. The compressed air flows into the explosion compartments in wing 630 through the one-way valve 83. The trippet 61 blocks the slot 84 as shown in FIG. 12B. As the impact head 60 is hit and moves backward, the compressed air flows into the payload compartment 62 as shown in FIG. 12A to push the trippet to squeeze the water to spray out completely.

Figure 14B:
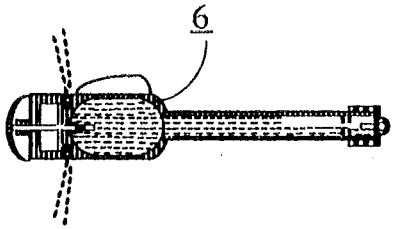
Figure 14C:
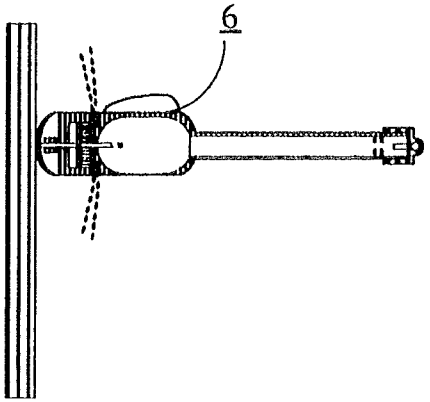
Figure 14A:
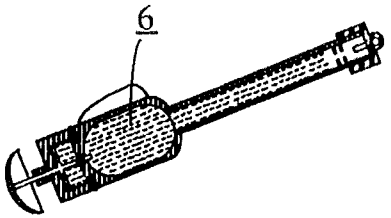

The water grenade 6 can function independently. As shown in FIG. 14A, the impact head 60 is pulled out and the water flows into the payload compartment 65. As shown in FIG. 14B, the impact head 60 is pushed back, the water is squeezed out and sprays forward on the enemy. The water grenade also can be thrown with the hand as the hand grenade. As shown in FIG. 14C, the water grenade is thrown by the hand and explodes to sprays the water on the enemy.

While present exemplary embodiments of this invention, and methods of practicing the same, have been illustrated and described, it will be recognized that this invention may be otherwise variously embodied and practiced within the scope of the following claims.

What I claim is:

1. A pressurized squirt gun which emits an interrupted stream of water comprising a housing that is sealed in order to contain an overpressure of air with a cavity for water and a cavity for air in an upper portion of the squirt gun, said housing containing a pressurizer that injects air into said sealed housing upon operation of the pressurizer, a first inlet tube in said housing to deliever water under pressure from said water cavity to a flow interrupter, also in said sealed housing, said flow interrupter being a side-by-side, dual turbine with one side adapted to receive water from said inlet tube and the other side of the dual turbine adapted to receive pressurized air from the air cavity with the water turbine being radially offset from the air turbine, said flow interrupter having an outlet aperture connected to an output tube that is controlled by a trigger member for the squirt gun so that upon actuation of the trigger on a pressurized, water containing squirt gun, the turbine is caused to rotate by said pressure, thereby outputting water and air alternately into said outlet aperture with ultimate ejection from the squirt gun as an interrupted water stream.

2. A pressurized squirt gun according to claim 1, said pressurizer being a pump comprising two one-way valves and a piston, said piston being pressed and released alternatively; as said piston being released, air flowing into said pump through a first one-way valve; as said piston being pressed, air flowing from said pump into said reservoir through a second one-way valve.

3. A pressurized squirt gun according to claim 2 further comprising a link and an electrical motor, said link being connected between said piston and said electrical motor, as said electrical motor rotates, said piston being driven with said electrical motor.

4. A pressurized squirt gun according to claim 2 further comprising a handle, said piston being connected to said handle with a link, said handle being installed at a lower portion of a handgrip, the handle is pressed with grasping force of middle finger, index finger and little finger.

5. A pressurized squirt gun according to claim 1, said dual turbine is driven to rotate with an electrical motor, said electrical motor rotating a common axle of said dual turbine, blades of said air turbine and said water turbine rotating to suck and expel air and water into said output tube.

6. A pressurized squirt gun according to claim 1, further comprising a click sound generating mechanism, said click sound generating mechanism comprising a drum means and a stick means, on an axle of said turbine further comprising a cam means, said cam means shifting said stick means slowly and releasing said stick suddenly as said axle rotating, under biasing force of a spring, said stick means suddenly hitting on said drum means to generate click sound.

7. A pressurized squirt gun according to claim 1, wherein said air turbine receives pressurized air from a second inlet tube.

8. A simulated grenade for launching from an air pressurized squirt gun, the simulated grenade comprising a water compartment, air compartment, impact pad and piston, the simulated grenade having a housing with the housing containing the water and air compartments and the piston therein, the air compartment being in a rearward position in the housing and being adapted to accept pressurized air from a launcher, the impact pad connected to the piston where the impact pad is foremost and the piston is contained within the water compartment in the housing, the water compartment being provided with valved outlet ports for water ejection and at least one inlet port for the introduction of pressurized air, the at least one inlet port normally occluded by the piston, a valved air conduit bridging the air compartment and the at least one inlet port for retaining a portion of the pressurized air to drive the piston, wherein the air compartment will be pressurized by air pressure from a squirt gun launcher which will pressurize the air conduit and upon release from a squirt gun launcher the simulated grenade will impact with the impact pad dislodging the piston from the inlet port allowing air from the valved air conduit to drive the piston within the water compartment forcing water to be rejected from the valved outlet ports.

9. A simulated grenade according to claim 8, wherein said air compartment further comprises a nozzle.

10. A simulated grenade according to claim 8, wherein said air compartment further comprises a whistle.

11. A simulated grenade according to claim 8, further comprising a plurality of fins mounted outside said housing.

12. A simulated grenade according to claim 11, said valved air conduit is inside said fins.

13. A pressurized squirt gun according to claim 1 further comprising a launch means and a simulated grenade, said launch means being mounted on said squirt gun and holding said simulated grenade with a second trigger member, said simulated grenade comprising a water compartment, air compartment, impact pad and piston, said launch means comprising a barrel and a breechblock, said breechblock sealing a breech on said barrel, said simulated grenade having a housing, said housing fitting with the barrel of said launch means, the air compartment being in a rearward position of said simulated grenade, the impact pad connected to the piston where the impact pad is foremost and the piston is contained within the water compartment of said simulated grenade, the water compartment being provided with valved outlet ports for water ejection and at least one inlet port for the introduction of pressurized air, the at least one inlet port normally occluded by the piston, a valved air conduit bridging the air compartment and the at least one inlet port for retaining a portion of the pressurized air to drive the piston, mounting said simulated grenade into said launch means, the breech on said barrel being opened and allowing the air and/or water to flow between said squirt gun and said grenade, wherein the air compartment will be pressurized by air pressure from said squirt gun which will pressurized the air conduit and upon release from said squirt gun, the simulated grenade will impact with the impact pad dislodging the piston from the inlet port allowing air from the valved air conduit to drive the piston within the water compartment forcing water to be rejected from the valved outlet ports.

14. A pressurized squirt gun in combination with a simulated grenade comprising with a housing that is sealed in order to contain an overpressure of air with a cavity for water and a cavity for air in an upper portion of the squirt gun, said housing containing a pressurizer that injects air into said sealed housing upon operation of the pressurizer, said simulated grenade having a compartment, said compartment being in a rearward position and being adapted to accept pressurized air from said pressurized squirt gun and being filled with water before installation on said squirt gun, said housing further comprising a breechblock means under biasing of spring means sealing said housing of the pressurized squirt gun, as said simulated grenade is installed on the pressurized squirt gun with said simulated grenade pointing upward, the compartment of said simulated grenade pushes said breechblock means to open a gap allowing the water inside said compartment to exchange with air inside the housing of pressurized squirt gun, whereupon releasing said simulated grenade, under the overpressure of air in said compartment, said simulated grenade is launched, under biasing of said spring means and the overpressure of air, said breechblock means seals said housing again to prevent the overpressure of air from being released.

15. A pressurized squirt gun in combination with a simulated grenade according to claim 14, an outlet tube in said housing to deliver water under pressure from said water cavity, said pressurizer being a pump comprising two one-way valves and a piston, said piston being pressed and released alternatively; as said piston is released, air flows into said pump through a first one-way valve; as said piston is pressed, air flows from said pump into said reservoir through a second one-way valve, said piston being connected to a handle with a link, said handle being installed at a lower portion of a handgrip, the handle may be pressed by fingers of a user's hand, a trigger interrupting water flowing through said outlet tube, as said trigger is pressed by a user's index finger, said high pressure inside said reservoir forces fluid inside said reservoir to flow out an outlet.

* * * * *